US005445460A

United States Patent [19]

Nakajima

[11] Patent Number: 5,445,460

[45] Date of Patent: Aug. 29, 1995

[54] PRESSURE-CONTACT DEVICE FOR APPLYING PRINT HEAD ONTO PLATEN OF PRINTER

[75] Inventor: Takeshi Nakajima, Kanagawa, Japan

[73] Assignee: Sony Corporation, Tokyo, Japan

[21] Appl. No.: 199,878

[22] Filed: Feb. 22, 1994

[30] Foreign Application Priority Data

Feb. 26, 1993 [JP] Japan ..... 5-038784

[51] Int. Cl.[6] ..... B41J 2/335

[52] U.S. Cl. ..... 400/120.16; 400/56; 403/117; 403/DIG. 8; 74/497

[58] Field of Search ..... 400/120.16, 120.17, 400/120 HE, 56, 57, 58; 346/76 PH; 403/113, 117, 102, 59, 62, 145, 147, DIG. 8; 74/106, 122, 125, 497, 567

[56] References Cited

U.S. PATENT DOCUMENTS 4,653,951 3/1987 Bodle et al. ..... 403/147 X
5,064,300 11/1991 Kashiwaba ..... 400/120.16 X
5,087,926 2/1992 Wakui ..... 400/120.16
5,181,787 1/1993 Hosomi ..... 400/120.16
5,217,315 6/1993 Rosane ..... 403/117
5,265,966 11/1993 Schmidt ..... 400/120.16

FOREIGN PATENT DOCUMENTS 0101376 6/1984 Japan ..... 400/120.16
0031669 2/1989 Japan ..... 400/120.16

*Primary Examiner*—Chris A. Bennett
*Attorney, Agent, or Firm*—Ronald P. Kananen

[57] ABSTRACT

A print head pressure-contact device equipped with a linkage for applying a print head onto a platen of a printer, comprises a drive lever having a driven connection with a motor and a driven lever rotatably linked to the drive lever. The drive lever has a cam and the driven lever has a cam follower cooperative with the cam, such that a power transmission is changed from a linkage transmission to a cam transmission within a predetermined angle range with respect to an angle between the two levers.

10 Claims, 5 Drawing Sheets

PRESSURE-CONTACT DEVICE FOR APPLYING PRINT HEAD ONTO PLATEN OF PRINTER

BACKGROUND OF THE INVENTION

1. Field of the Invention

The present invention relates to a pressure-contact device through which a print head is brought into and out of pressure-contact with a platen of a printer, and specifically to a print head pressure-contact device for applying a thermal head onto a platen by way of a linkage.

2. Description of the Prior Art

Referring now to FIG. 8, there is shown a conventional pressure-contact device of a print head onto a platen. In FIG. 8, the print head pressure-contact device 101 includes a first shaft 102 serving as a drive shaft, a first lever 103 serving as a drive lever and rigidly fixed on the first shaft 102 at one end thereof, a second shaft 104 fixed on the other end of the first lever 103, and a second lever 105 serving as a driven lever and pivotably received by the second shaft 104 at one end thereof. The first shaft 102, the first lever 103, the second shaft 104, and the second lever 105 construct a linkage 108 for applying a print head 109 onto a platen 110. The second lever 105 has a third shaft 106 firmly fixed at the other end thereof. The third shaft 106 pivotably receives a print head pressure-contact plate 107. The head pressure-contact plate 107 is pivotably received on a print-head support 111 by way of a pin 115. As seen in FIG. 8, the print head 109 is mounted on the lower surface of the head support 111. The head support 111 is pivotably received by means of a stationary shaft 112 firmly fixed onto a printer housing (not shown). A spring 113 such as a coil spring is arranged between the head pressure-contact plate 107 and the head support 111, for pressing the head 109 onto the outer periphery of the platen 110 with a desired pressure. Under the condition in which the head 109 is out of contact with the platen 110, the head support 111 is kept in a spring set position wherein the end of the support 111 abuts a flanged stopper 114 integrally formed with the head pressure-contact plate 107. The first shaft 102 has a driven connection with a driving system which generally includes an electric motor (not shown) and a reduction gear set both mounted on the printer housing (not shown).

With the above arrangement, torque generated by the drive motor is transmitted from the first shaft 102 to the first lever 103. In accordance with rotational movement of the first lever 103, the second lever 105 is extended and bent with respect to the first lever 103, with the result that the head pressure-contact plate 107 and the platen 110 are movable towards and away from each other. Accordingly, the head 109 is movable in such a manner as to be brought into pressure-contact with and out of contact with the outer periphery of the platen 110 in accordance with the rotational movement of the first lever 103. In the previously-noted conventional head pressure-contact device with the linkage 108 constructed by the two levers 103 and 105 coupled rotatably to each other, there is a drawback as described hereinbelow described in detail.

Supposing that the first shaft 102 corresponds to an engine crankshaft, the first driving lever corresponds to a crank, the second shaft 104 corresponds to a crankpin, the second driven lever 105 corresponds to a connecting rod, and the third shaft 106 corresponds to a piston pin, the third shaft 106 has a lower limit point (viewing FIG. 8) similar to a top dead center generally abbreviated as "TDC" in the case of reciprocating engines, when the two levers 103 and 105 are aligned with each other. Although the lower limit point of the third shaft 106 must be univocally determined, however, the lower limit point tends to fluctuate owing to errors in machining accuracy of the first and second levers 103 and 105, several deviations, namely a deviation from an ideal connecting point of the first shaft 102 to the first lever 103, an eccentricity of an ideal bearing hole of the second lever 105 rotatably coupled with the second shaft 104, and a deviation from an ideal mounting point of the third shaft 106 on the second lever 105, or owing to a designated backlash or play in the driving system consisting of a drive motor and a reduction gear set. Thus, such a conventional head pressure-contact device requires a high machining accuracy. When the head 109 is pressed onto the platen 110, a reaction force is created to act on the drive shaft 102 through the links 103 and 105, owing to a pressure of the head 109 pressed onto the platen. Across the TDC of high degree of freedom as appreciated from a free movement of the levers rightwards and leftwards at the TDC, a direction of moment of the reaction acting on the first shaft 102 in a lever position as indicated by a solid line of FIG. 8 before the third shaft 106 reaches to the TDC becomes opposite to a direction of moment of the reaction acting on the first shaft 102 in a lever position as indicated by a two-dotted line of FIG. 8 after the third shaft 106 has reached the TDC. That is to say, the linkage 108 exhibits an excessively unstable force balance in the vicinity of the TDC. Therefore, there is a tendency for the pair of levers 103 and 105 easily to escape out of the TDC owing to backlash of the reduction gear of the driving system, upon the third shaft 106 has reached to the TDC. Furthermore, the life of the motor is shortened due to the above-mentioned opposite reaction moment acting on the driven shaft. In order to avoid this, it is necessary to precisely stop the pair of levers 103 and 105 in a designated position in which the third shaft 106 does not yet reach to the TDC. Thus, the conventional head pressure-contact device requires a high-accuracy control for the driving system.

SUMMARY OF THE INVENTION

It is, therefore in view of the above disadvantages, an object of the present invention to provide an improved print head pressure-contact device with a linkage equipped with a pair of levers, namely a drive lever having a driven connection with a drive shaft and a driven lever having a driven connection with the drive lever, which can provide a stable force balance in the vicinity of a top dead center (TDC) of the linkage by continuously holding the TDC within a predetermined angular range with regard to the angle between the pair of levers.

It is another object of the invention to provide an improved print head pressure-contact device with a linkage equipped with a pair of levers, namely a drive lever having a driven connection with a drive shaft and a driven lever having a driven connection with the drive lever, in which a power transmission can be changed from a linkage transmission to a cam transmission just before the linkage reaches to a top dead center (TDC) at which the two levers are aligned with each other.

It is a further object of the invention to provide an improved print head pressure-contact device with a linkage equipped with a pair of levers, namely a drive lever having a driven connection with a drive shaft and a driven lever having a ks driven connection with the drive lever, which can identically keep a direction of the reaction moment which is created by pressure of the head brought into pressure-contact with the platen and acts on the drive shaft, even after it has been reached to a top dead center (TDC) at which the two levers are aligned with each other.

In brief, the aforementioned objects of the invention are achieved by a print head pressure-contact device equipped with a linkage which can provide a cam transmission as well as a linkage transmission.

According to one aspect of the invention, a print head pressure-contact device for applying a print head onto a platen of a printer, comprises a linkage having a driven connection with a driving system, and a print head pressure-contact means which mounts the head thereon, the head pressure-contact means being rotatably connected to the linkage for putting the head into pressure-contact with the platen through its pivotal movement. The linkage includes a first shaft which is a drive shaft of the driving system, a first lever rigidly connected to the first shaft at one end thereof for rotating together with the first shaft, a second shaft attached to the other end of the first lever, a second lever rotatably linked to the first lever at one end thereof by the second shaft, and a third shaft attached to the other end of the second lever for rotatably receiving the head pressure-contact means thereon. The first lever has a cam for changing a power transmission from a linkage transmission performed by the linkage to a cam transmission, while the second lever has a cam follower engaging and disengaging with and from the cam. The linkage transmission is replaced by the cam transmission, when an angle between the first and second levers is within a predetermined angle range containing 180° at which the two levers are aligned to each other.

It is preferable that the second lever has a capsule-shaped groove-like bearing portion elongated in a direction of a line segment interconnecting the central axes of the second and third shafts, for rotatably fitting the second shaft into the bearing portion and for permitting a longitudinal sliding movement of the second shaft within the bearing portion, so as to certainly prevent the power from being transmitted from the first lever through the second shaft to the second lever during the cam transmission.

The cam has a cam surface configured to a curved surface of a circle with a first predetermined radius and a circle center identical to the central axis of the first shaft, while the cam follower has a cam follower surface configured to a curved surface of a circle with a second predetermined radius and a circle center identical to the central axis of the third shaft. Alternatively, the cam may include a cam surface configured to a curved surface of a circle with a first predetermined radius and a circle center identical to the central axis of the first shaft, while the cam follower may include a cam follower surface configured to a flat plane equal to a tangent plane consisting of tangent lines all of which are tangential to a circle with a second predetermined radius and a circle center identical to the central axis of the third shaft and are normal to any line segment perpendicular to the second and third shafts, so that a contact point between the cam surface of the cam of the first lever and the cam follower surface of the cam follower of the second lever is positioned backward of a line segment interconnecting the first and third shafts in case of the angle between the two levers in excess of 180°, whereby a direction of moment of reaction acting on the first shaft before the angle reaches to 180° is kept identical to a direction of moment of reaction acting on the first shaft after the angle has reached to 180°. The predetermined angle range may preferably set to be 170° through 200°. The print head pressure-contact means may include a pivotable print head pressure-contact plate rotatably connected to the third shaft, a print-head support mounting thereon the head, and a spring disposed between the head pressure-contact plate and the head support. The head pressure-contact plate and the head support are pivotably supported by a common pivot shaft, and additionally the spring acts to maintain a relative position of the head support to the head pressure-contact plate in a spring-set position when the head is out of contact with the platen and acts to apply the head onto the platen with a predetermined pressure when the head is brought into contact with the platen.

The angle between the first and second levers is essentially equivalent to an angle between a line segment interconnecting the first and second shafts and a line segment interconnecting the second and third shafts.

DESCRIPTION OF THE PREFERRED EMBODIMENTS

First embodiment

Figure 1:
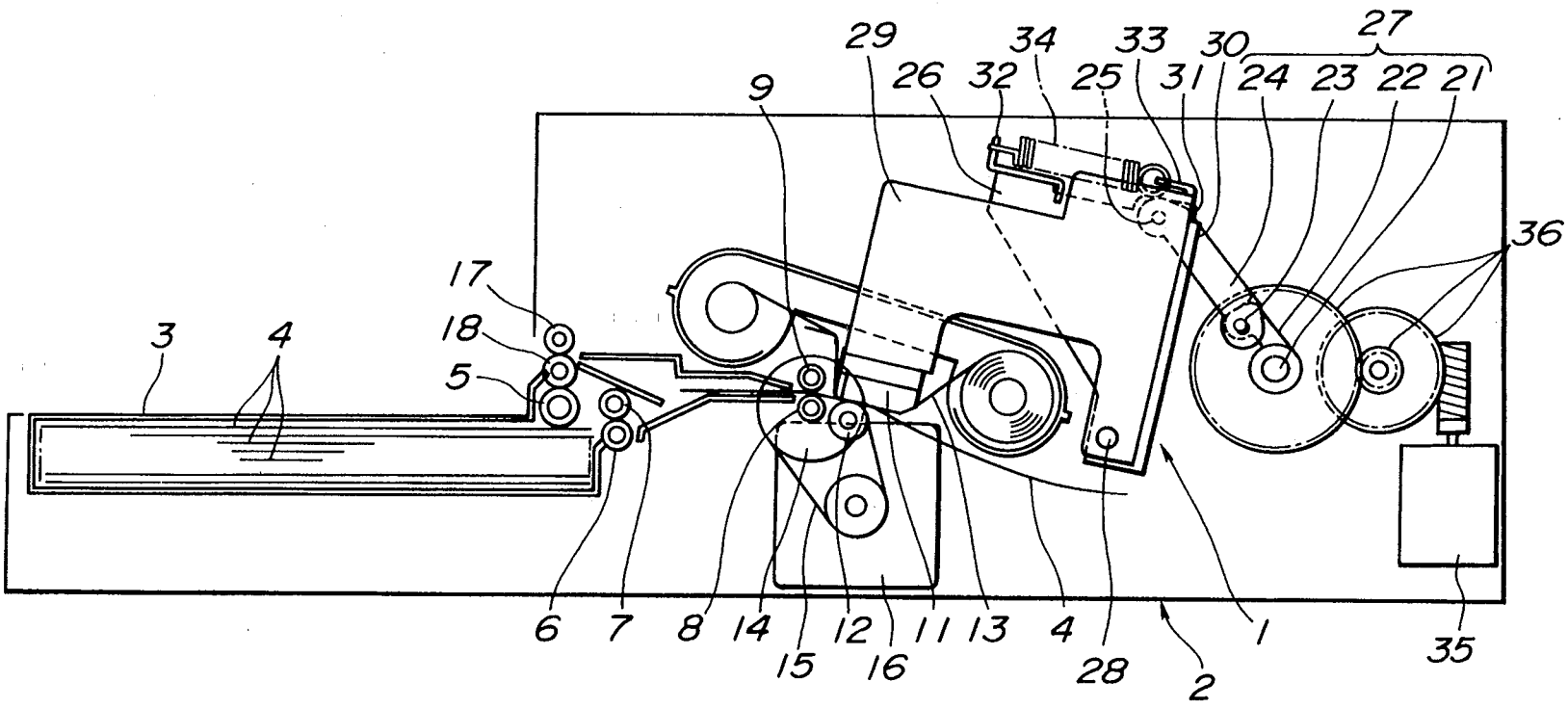
FIG. 1 is a schematic side view illustrating a printer with a print head pressure-contact device according to the invention.

Referring now to the drawings, particularly to FIGS. 1 through 5, there is shown a printer employing a first embodiment of a print head pressure-contact device 1. As shown in FIG. 1, the printer 2 includes paper supply rollers 5 and 7 rotatably fixed in the printer housing for feeding photographic printing sheets 4 accommodated in a paper tray 3, and a separate roller 6 arranged parallel to the axes of the supply rollers 5 and 7 for separately selecting one sheet from the incoming sheets 4. The selected sheet 4 is further fed to reach to a predetermined position through the rollers 5 and 7 and the separate roller 6. When the selected photographic printing paper 4 has reached the predetermined position, a thermal print head 11 is moved towards a platen 12 by way of the head pressure-contact device 1 of the first embodiment and simultaneously the sheet 4 is sandwiched between a capstan roller 8 and a pinch roller 9. Thereafter, the selected sheet 4 is overlapped with an ink ribbon 13 and then the sheet 4 is brought into pressure-contact with the platen 12. Driving force of a paper feeding motor 16 is transmitted to the capstan roller 8 through a belt 15 and a pulley 14, with the result that the sheet 4 which is in pressure-contact with the platen 12 is further fed towards the side of paper-exhausting rollers 17 and 18 through rotational movement of the capstan roller 8 with a proper tension created between the two engaging points, namely one point being a pressure-contact point of the head 11 on the platen 12 and the other point being the abutting point between the capstan roller 8 and the pinch roller 9. At the same time as the capstan roller 8 is rotated by the motor 16, the thermal head 11 is energized, with the result that ink from the ink ribbon 13 is transferred to the photographic sheet 4. In this manner, printing on the photographic sheet 4 is carried out.

Figure 2:
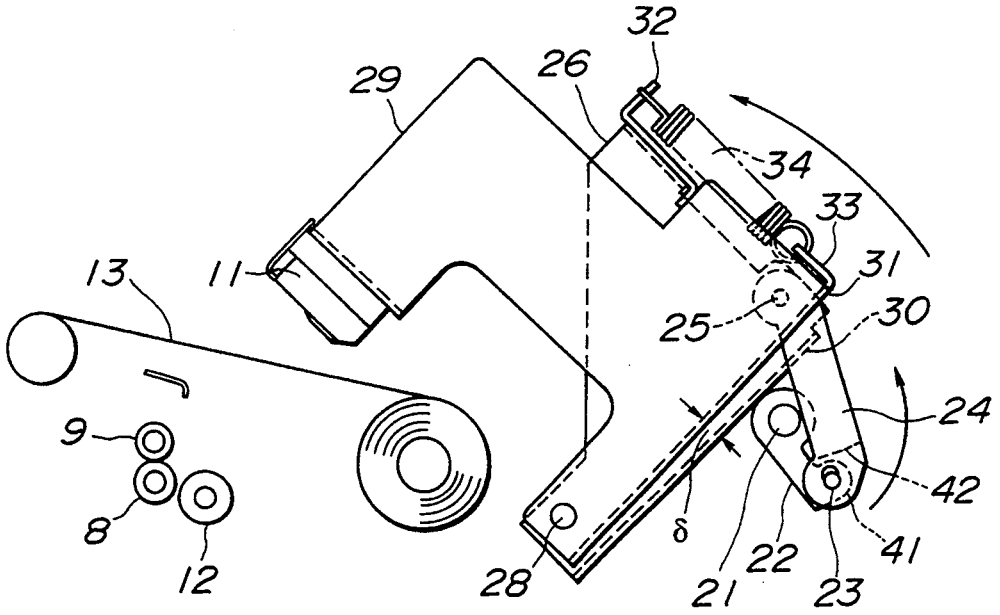
FIG. 2 is a side view, with portions broken away for the sake of clarity, of the head pressure-contact device under a condition wherein the head is positioned away from the platen.
Figure 3:
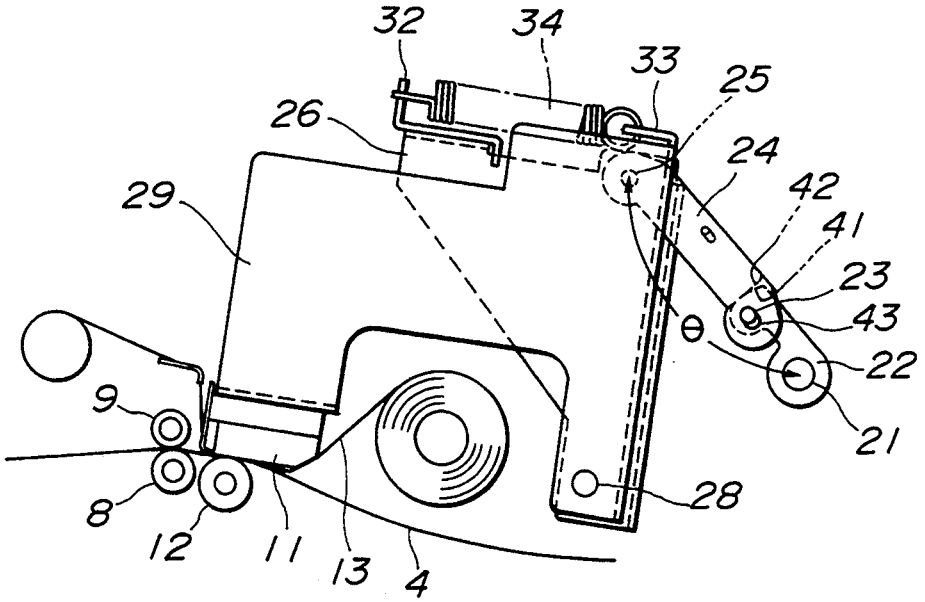
FIG. 3 is a side view, with portions broken away for the sake of clarity, of the head pressure-contact device under a condition wherein the head is brought into contact with the platen.

As shown in FIGS. 2 and 3, the head pressure-contact device of the first embodiment includes a first shaft 21 which serves as a drive shaft, a first lever 22 which serves as a drive lever and which is rigidly fixed to the first shaft 21 at one end thereof, a second shaft 23 fixed on the other end of the first lever 22 so as to laterally extend therefrom, and a second lever 24 which serves as a driven lever and which is pivotably received by the second shaft 23 at one end thereof.

The first shaft 21, the first lever 22, the second shaft 23 and the second lever 24 form a linkage 27 for moving the head 11 into pressure-contact with the platen 12. The first shaft 21 has a driven connection with a driving system which generally includes an electric motor 35 and a reduction gear set 36 drivingly connected to the motor 35. The second lever 24 has a third shaft 25 firmly fixed at the other end thereof. The third shaft 25 is rotatably connected to the upper-right end of a substantially triangle, pivotable print head pressure-contact plate 26. The lower end of the head pressure-contact plate 26 and the lower-right end of a substantially C-shaped print-head support 29 are pivotably supported by way of a common pivot shaft 28 rigidly fixed onto a printer housing (not shown). The thermal head 11 is mounted on the lower-left end of the head support 29. The head support 29 is connected through a coil spring 34 to the head pressure-contact plate 26. In the embodiment, the coil spring 34 is comprised of a tension spring operably disposed between a spring-hook hanger 32 attached to the head pressure-contact plate 26 and a spring-hook hanger 33 attached to the head support 29. Under the conditions illustrated in FIG. 2, wherein the thermal head 11 is positioned away from the platen 12, a relative position of the head support 29 to the head pressure-contact plate 26 is maintained in a spring-set position in which a right-angled flange 30 of the head pressure-contact plate 26 and a right-angled flange 31 of the head support 29 are offset to each other by a predetermined phase angle or a predetermined tapered aperture $\delta$. Although the spring 34 can be extended until the right-angled flange 31 of the head support 29 abuts the right-angled flange 30 of the head pressure-contact plate 26, a slight aperture between the two right-angled flanges 30 and 31 still remains, so that the head 11 can be brought into contact with the platen 11 with a proper pressure under a condition wherein the right-angled flange 31 has very closely approached the opposing flange 30 in such a manner as to be arranged essentially parallel to the right-angled flange 30, as seen in FIG. 3. At the initial position of the first lever 22 shown in FIG. 2, when the first lever 22 is rotated in its counterclockwise direction in accordance with counterclockwise rotational movement of the first shaft 21, torque developed in the drive motor 35 and the reduction gear set 36 is converted through the linkage 27 to a pressure acting on the head pressure-contact plate 26 via the third shaft 25. As a result, the head pressure-contact plate 26 is rotated counterclockwise and thus the head support 29 is also rotated counterclockwise about the common pivot shaft. 28 by the spring 34. Thereafter, as shown in FIG. 3, the first and second levers 22 and 24 are aligned with each other owing to the rotational movement of the first lever 22, such that the first, second and third shafts 21, 23 and 25 are aligned to each other. Under the condition wherein the two levers 22 and 24 are aligned with each other, the ink ribbon 13 and the photographic sheet 4 are both pressed onto the platen 12 by the thermal head 11. The structure of the first and second levers 22 and 24 will be hereinbelow described in detail in accordance with the explanatory views of FIGS. 4 and 5.

Figure 4:
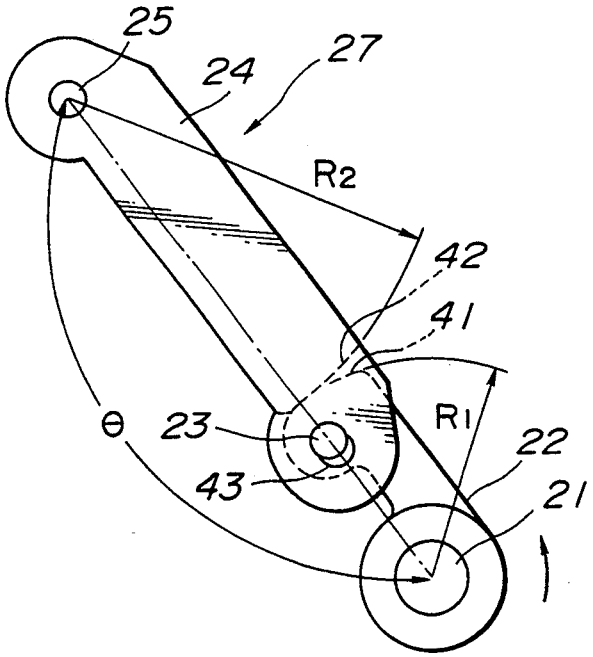
FIG. 4 is a side view illustrating a first embodiment of a linkage incorporated into the head pressure-contact device according to the invention.
Figure 5:
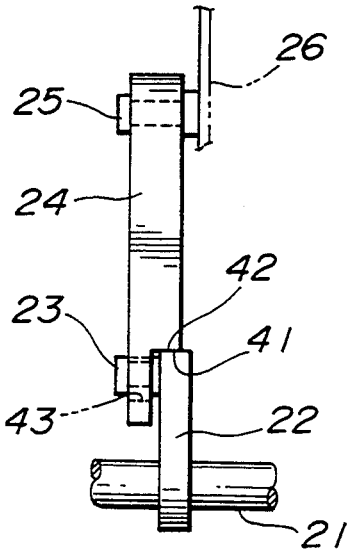
FIG. 5 is a back elevation of the linkage of the first embodiment.

Referring now to FIG. 4, the first lever 22 is formed with a cam 41, while the second lever 24 is formed with a cam follower 42 for co-operation with the cam 41. The cam surface of the cam 41 is configured to have a curved circular surface with a radius of R1. The origin of the radius is concentric with the axis of the first shaft 21. The cam follower 42 has the contour configured to have a circular curved surface having a radius R2 which is coincident with the axis of the third shaft 25. In FIGS. 3 and 4, character $\theta$ denotes the angle between the two levers 22 and 24, namely the angle between a line segment interconnecting the first and second shafts 21 and 23 and a line segment interconnecting the second and third shafts 23 and 25. Note that the cam 41 is brought into contact with the cam follower 42 within a predetermined angle range of the angle $\theta$, for example 170° through 200°, as well as at the angle $\theta$ of 180°, in the head pressure-contact device of the first embodiment. As appreciated from FIG. 4, the second shaft 23 rotatably coupling the two links 22 and 24 is rigidly fixed on the first lever 22 and rotatably received by a bearing portion 43 provided at the second lever 24. Note that the bearing portion 43 is comprised of a capsule-shaped hole or groove elongated in the direction of a line segment interconnecting the central axes of the two shafts 23 and 25. Thus, the second shaft 23 is rotatable and longitudinally slidable within the capsule-shaped bearing hole 43. Under the non-contact condition wherein the cam 41 is out of contact with the cam follower 42, the second shaft 23 comes into contact with the longitudinally extended end of the bearing portion 43, with the result that the first lever 22 pushes the second lever 24 by the link transmission created by the first lever 22, the second shaft 23 and the second lever 24. In the embodiment, the angle $\theta$ between the two levers 22 and 24 is designed to be less than 170° under the non-contact condition. As soon as the angle $\theta$ reaches to 170° in accordance with the counterclockwise rotational movement of the two levers 22 and 24 rotatably coupled or linked to each other, the cam surface of the cam 41 is brought into contact with the curved surface of the cam follower 42, and simultaneously with the cam contact, the outer peripheral surface of the second shaft 23 is out of contact with the inner peripheral wall surface of the bearing portion 43. As a result, the power transmission from the first lever 22 to the second lever 24 is changed from a linkage (lever) transmission of the linkage consisting of the first lever 22, the second shaft 23 and the second lever 24 to a cam transmission by the cam device consisting of the cam 41 and the cam follower 42. In the head pressure-contact device of the first embodiment, since the engagement relationship between the cam 41 and the cam follower 42 is designed so that the cam surface of cam 41 comes into contact with the mating surface of the cam follower 42 within a particular range of the angle $\theta$, namely 170° through 200°, the power transmission is performed by the cam transmission in the above-noted particular angle range, until the angle $\theta$ reaches 200° from the time the angle $\theta$ has become 170°. During the cam transmission, the second shaft 23 is kept in a non-drive state by the capsule-shaped elongated bearing portion 43, and therefore prevents the previously-noted linkage transmission.

Second embodiment

Figure 6:
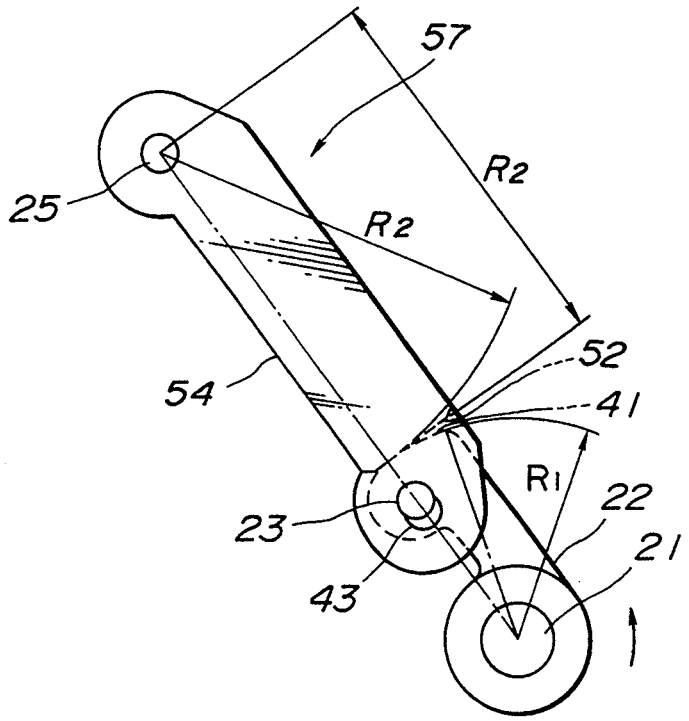
FIG. 6 is a side view illustrating a second embodiment of a linkage incorporated in the head pressure-contact device under a particular condition wherein two levers are aligned with each other at a top dead center position.
Figure 7:
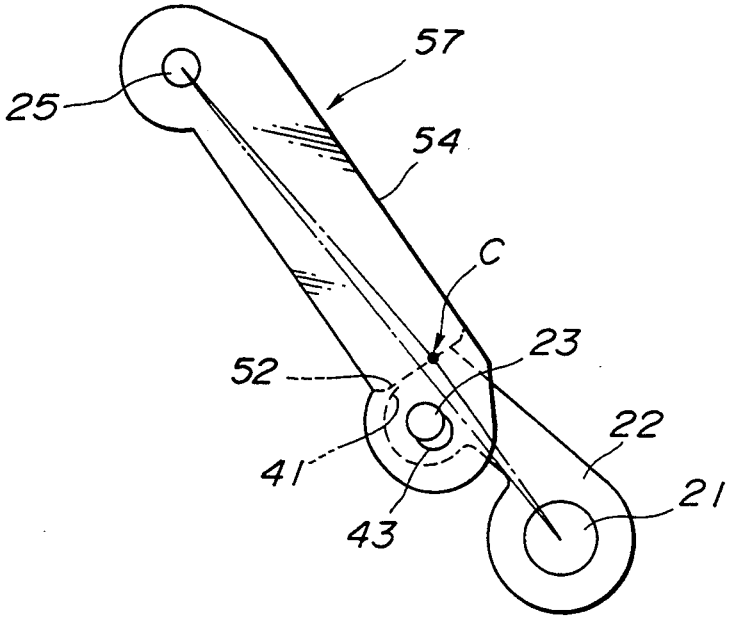
FIG. 7 is a side view illustrating the second embodiment under a particular condition of the linkage just after the linkage has passed through the top dead center position.
Figure 8:
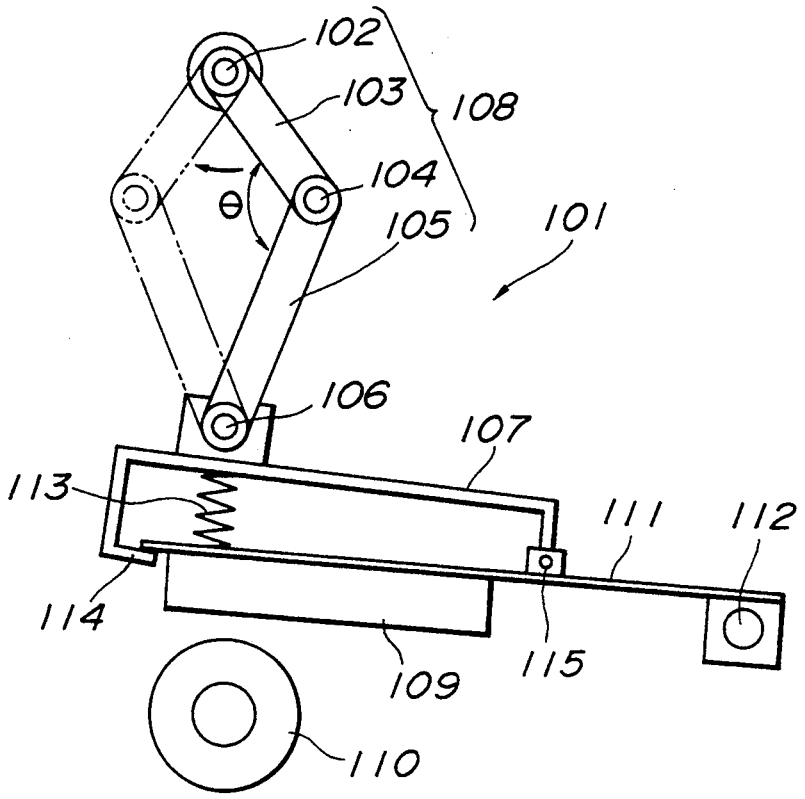
FIG.8 (PRIOR ART)
FIG. 8 is a side view illustrating a conventional print head pressure-contact device discussed in the opening paragraphs of this specification.

Referring now to FIGS. 6 and 7, there is shown a second embodiment of the print head pressure-contact device. The basic construction of the head pressure-contact device of the second embodiment as shown in FIGS. 6 and 7 is similar to that of the first embodiment as shown in FIGS. 1 through 5. Therefore, the same reference numerals used in the first embodiment of FIGS. 1 through 5 will be applied to the corresponding elements used in the second embodiment of FIGS. 6 and 7, for the purpose of comparison between the first and second embodiments. The linkage 57 incorporated in the head pressure-contact device of the second embodiment is different from the linkage 27 incorporated in the head pressure-contact device of the first embodiment, in that the second lever 24 equipped with the cam follower 42 which has the cam follower surface configured to the curved surface of the circle with the radius R2 and an origin concentric with the axis of the third shaft 25 is replaced by a second lever 54 equipped with a cam follower 52 which has a flat plane equal to a tangent plane consisting of tangent lines all of which are tangential to the circle with the radius R2 and the circle center identical to the central axis of the third shaft 25 and are normal to any line segment perpendicular to the second and third shafts 23 and 25. With the above-noted linkage 57, the contact point C between the cam surface of the cam 41 of the first lever 22 and the mating surface of the cam follower 52 of the second lever 54 is positioned backward of the line segment interconnecting the first and third shafts 21 and 25, in case of the angle $\theta$ in excess of 180°. Thus, the direction of moment of reaction acting on the first shaft 21 before the third shaft 25 reaches top dead center (TDC) can be kept identical to the direction of moment of reaction acting on the first shaft 21 after the third shaft 25 has reached the TDC. As appreciated from the above, the linkage 57 of the second embodiment exhibits a stable force balance within the predetermined range of the angle $\theta$ in the vicinity of the TDC in the same manner of the linkage 27 of the first embodiment.

As set forth above, the head pressure-contact device according to the invention can provide a reliable head pressure-contact action without requiring a high-accuracy control of the driving system. In addition to the above, the life of the motor of the driving system can be extended, because the direction of the reaction moment is identical before and after the TDC.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A print head pressure-contact device for applying a print head onto a platen of a printer, said head pressure-contact device comprising:

a print head pressure-contact means which supports the print head thereon, said head pressure-contact means being pivotally supported so as to be pivotal in a manner which moves the print head into pressure contact with the platen;

a first shaft in drive connection with a motor;

a first lever, said first lever having a first end and a second end, said first lever being rigidly connected to said first shaft at the first end thereof;

a second shaft attached to the second end of said first lever;

a second lever, said second lever having a first end and a second end, the first end of said second lever being formed with an elongate groove in which said second shaft is slidably and rotatably received;

a third shaft which pivotally interconnects the second end of said second lever with said head pressure-contact means;

a cam provided on the second end of said first lever;

a cam follower provided at the first end of said second lever, said cam follower engaging said cam and producing a force which causes said print head pressure contact means to pivot and press the print head into contact with the platen when an angle between said first and second levers is within a predetermined angle range including an angle of 180° at which the two levers are aligned to each other.

2. The print head pressure-contact device as set forth in claim 1, wherein said elongate groove is elongated in a direction of a line segment interconnecting the axes of said second and third shafts.

3. The print head pressure-contact device as set forth in claim 1, wherein said cam has a curved surface having a first predetermined radius which is concentric with an axis of said first shaft, and wherein said cam follower has a curved surface having a second predetermined radius which is concentric with an axis of said third shaft.

4. The print head pressure-contact device as set forth in claim 1, wherein said cam has a curved surface having a first predetermined radius which is coincident with an axis of said first shaft, wherein said cam follower has a surface configured to a flat plane equal to a tangent plane consisting of tangent lines all of which are tangential to a circle with a second predetermined radius concentric with an axis of said third shaft, and which are normal to any line segment perpendicular to said second and third shafts, so that a contact point between the cam surface of said cam and the cam follower surface of said cam follower is spaced from a line segment interconnecting the axes of said first and third shafts when the angle between said first and second levers is in excess of 180°, whereby a direction of a reaction moment acting on said first shaft before said angle reaches 180° is identical to a direction of the reaction moment acting on said first shaft after said angle has reached 180°.

5. The print head pressure-contact device as set forth in claim 1, wherein said predetermined angle range is from 170° to 200°.

6. The print head pressure-contact device as set forth in claim 1, wherein said print head pressure-contact means includes:

a pivotable print head pressure-contact plate rotatably connected to said third shaft;

a print-head support which supports said head; and a spring disposed between said head pressure-contact plate and said head support;

said head pressure-contact plate and said head support being pivotably supported on a common pivot shaft;

said spring acting to maintain a relative position between said head support and said head pressure-contact plate in a spring-set position wherein the head is out of contact with said platen and acting to bias said head against the platen with a predetermined pressure when the head is brought into contact with the platen.

7. The print head pressure-contact device as set forth in claim 1, wherein said angle between said first and second levers is equivalent to an angle between a line segment interconnecting the axes of said first and third shafts and a line segment interconnecting said second and third shafts.

8. A pressure-contact device comprising:

a support structure, said support structure being pivotally supported so as to be pivotal into pressure contact with a second structure;

a first shaft, said first shaft being adapted to be placed in drive connection with a motor;

a first lever, said first lever having a first end and a second end, said first lever being rigidly connected to said first shaft at the first end thereof;

a second shaft attached to the second end of said first lever;

a second lever, said second lever having a first end and a second end, the first end of said second lever being formed with an elongate groove in which said second shaft is slidably and rotatably received;

a third shaft which pivotally interconnects the second end of said second lever with said support structure;

a cam provided on the second end of said first lever; and a cam follower provided at the first end of said second lever, said cam follower engaging said cam and producing a force which causes said support structure to pivot into contact with the second structure when an angle between said first and second levers is in a predetermined angle range including an angle of 180° at which the two levers are aligned to each other.

9. A device comprising:

a first lever which has a first end operatively connected with a drive shaft;

a second lever operatively connected at a first end to a second end of said first lever, said second lever having a second end which is pivotally connected with a displaceable support structure;

a cam formed on one of the second end of said first lever and the first end of said second lever;

a cam follower formed on the other of the second end of said first lever and the first end of said second lever;

means interconnecting said first and second levers for allowing relative movement between said first and second levers and for allowing said cam and cam follower to become the sole source of force which is applied through said second lever to displace said displaceable support structure, when a predetermined angular relationship between said first and second levers occurs.

10. A device as set forth in claim 9, wherein said interconnecting means comprises an elongate groove formed in one of said first and second levers and a pin which is provided on the other of said first and second levers and which is slidably and rotatably received in said elongate groove.

* * * * *